US007946462B2

(12) United States Patent
Higuchi et al.

(10) Patent No.: US 7,946,462 B2
(45) Date of Patent: May 24, 2011

(54) ELECTRIC STAPLER

(75) Inventors: Kazuo Higuchi, Tokyo (JP); Tomokazu Matsui, Tokyo (JP); Futoshi Kameda, Tokyo (JP)

(73) Assignee: Max Co., Ltd., Tokyo (JP)

( * ) Notice: Subject to any disclaimer, the term of this patent is extended or adjusted under 35 U.S.C. 154(b) by 247 days.

(21) Appl. No.: 11/887,613

(22) PCT Filed: Apr. 7, 2006

(86) PCT No.: PCT/JP2006/307493

§ 371 (c)(1),
(2), (4) Date: Oct. 2, 2007

(87) PCT Pub. No.: WO2006/109746

PCT Pub. Date: Oct. 19, 2006

(65) Prior Publication Data

US 2009/0101691 A1 Apr. 23, 2009

(30) Foreign Application Priority Data

Apr. 7, 2005 (JP) ..... P. 2005-110773

(51) Int. Cl.
*B27F 7/36* (2006.01)

(52) U.S. Cl. ..... 227/8; 227/4; 227/2; 227/120; 227/131

(58) Field of Classification Search ..... 227/1–8, 227/120, 131, 155
See application file for complete search history.

(56) References Cited

U.S. PATENT DOCUMENTS 4,313,670 A * 2/1982 Caldwell ..... 399/410
4,508,329 A * 4/1985 Hubler et al. ..... 270/58.08
4,542,844 A * 9/1985 Olesen et al. ..... 227/7
4,574,993 A * 3/1986 Yamanoi ..... 227/131
4,597,518 A * 7/1986 Paul ..... 227/128
4,720,033 A * 1/1988 Olesen ..... 227/131
5,100,119 A * 3/1992 Komada et al. ..... 270/58.14
5,141,143 A * 8/1992 Ebner et al. ..... 227/129
5,269,451 A * 12/1993 Udagawa et al. ..... 227/120
5,269,503 A 12/1993 Hiroi et al.
5,413,266 A * 5/1995 Jairam ..... 227/129
5,580,066 A * 12/1996 Jairam ..... 227/123
6,050,471 A * 4/2000 Yagi ..... 227/119

(Continued)

FOREIGN PATENT DOCUMENTS

EP 1 136 208 A1 9/2001

(Continued)

*Primary Examiner* — Rinaldi I. Rada
*Assistant Examiner* — Lindsay Low
(74) *Attorney, Agent, or Firm* — Drinker Biddle & Reath LLP

(57) ABSTRACT

A slide frame is mounted on a driver unit that can be vertically reversed on a base frame. A guide pin disposed in the slide frame engages with a concave portion of a cam plate portion formed in the base frame. When a fixation releasing handle of the driver unit is operated, a lever pushes the slide frame to slide the slide frame and the guide pin is deviated from the concave portion to rotate the driver unit. In a state where the driver unit is fixed in a regular posture, since the guide pin is pushing a switch lever, the detection switch is kept turned ON and thus an electric stapler is in an operable state. When the driver unit is rotated, the switch lever is released from the press of the guide pin and the detection switch is turned OFF, thereby cutting off the power.

10 Claims, 10 Drawing Sheets

U.S. PATENT DOCUMENTS

| | | | | |
|---|---|---|---|---|
| 6,325,267 | B1 * | 12/2001 | Yoshie et al. | 227/2 |
| 6,536,646 | B1 * | 3/2003 | Pinczewski et al. | 227/5 |
| 6,543,667 | B2 * | 4/2003 | Yoshie et al. | 227/120 |
| 6,565,075 | B2 * | 5/2003 | Ishizaki | 270/58.09 |
| 6,565,076 | B2 * | 5/2003 | Kubota | 270/58.09 |
| 7,044,349 | B2 * | 5/2006 | Adams et al. | 227/82 |
| 7,080,767 | B2 * | 7/2006 | Kurabayashi | 227/111 |
| 7,306,131 | B2 * | 12/2007 | Bargo et al. | 227/119 |
| 2003/0197045 | A1 * | 10/2003 | Luo | 227/2 |
| 2004/0245309 | A1 | 12/2004 | Mochizuki et al. | |

FOREIGN PATENT DOCUMENTS

| | | | |
|---|---|---|---|
| EP | 1 428 630 | A1 | 6/2004 |
| JP | 5-80679 | | 11/1993 |
| JP | 8-183007 | | 7/1996 |
| JP | 2003-53679 | | 2/2003 |

* cited by examiner

ELECTRIC STAPLER

TECHNICAL FIELD

The present invention relates to an electric stapler, and more particularly, to a safety device having a structure for loading a staple cartridge by vertically reversing a driver mechanism.

BACKGROUND ART

An electric stapler driven by a motor, a solenoid, or the like is provided with a safety device for cutting off power at the time of replacing a cartridge due to danger of fault operation of a driver mechanism when replacing a staple cartridge or removing a jammed staple.

A safety device includes a pin, a protrusion, or the like disposed in a top cover of an electric stapler and a microswitch disposed in a chassis. When the top cover is detached at the time of replacing the staple cartridge, the protrusion disposed in the top cover departs from the detection switch; the detection switch is OFF; the power is cut off; and thus the electric stapler does not operate due to erroneous manipulation or vibration. In JP-A-08-183007, there is disclosed an electric stapler that has a door switch and detects that the door switch is closed after replacing a staple cartridge, thereby performing an initialization operation.

The electric stapler and the staple cartridge have various structures, for example, so as to mount the staple cartridge from a lower portion of a driver unit disposed in an upper portion of a clincher into the driver unit, on the basis of mechanism design or a shape of the staple cartridge.

A lower surface of the driver unit is opposed to the clincher. Accordingly, when the staple cartridge is detached in the lower portion of the driver unit as described above, the driver unit as a unit is allowed to rotate about a base portion; the driver unit is reversed so that the lower surface thereof is directed upward; and in this state the staple cartridge is detached from the upper portion of the driver unit.

When the known safety device is applied to the electric stapler with such a configuration, the power is cut off by detaching a switch opening-closing member such as a top cover or closing the switch in a manual; the driver unit is reversed; and then the staple cartridge is replaced. Even after the replacement, the stapler is required to return to the initial state in the opposite order to the above order. Accordingly, it takes a long time.

DISCLOSURE OF THE INVENTION

According to one or more embodiments of the invention, there is provided a safety device of an electric stapler in which trouble in replacing a cartridge is reduced in a driver-reversing electric stapler to improve a manipulation performance.

According to one or more embodiments of the invention, the electric stapler is configured so that a driver unit is disposed on a base frame so as to be vertically reversed and a staple cartridge is loaded or replaced in the driver unit. The electric stapler includes a lock mechanism that locks the drive unit in a regular posture and the vertically reversed posture; and a detection switch that is turned ON and OFF in the regular posture and the other postures in connection with the lock mechanism. The electric stapler is operable in the regular posture of the driver unit and is inoperable in the other postures thereof, on the basis of the state of the detection switch.

According to one or more embodiments of the invention, the lock mechanism includes a movable pin or a movable claw that is disposed in the driver unit; and an engagement portion such as a concave portion that is formed in the base frame. When the driver unit is locked in the regular posture, the movable pin or the movable claw of the lock mechanism engages with the engagement portion of the base frame and pushes the detection switch to turn ON the detection switch.

According to one or more embodiments of the invention, when the driver unit is moved from the regular posture at the time of loading or replacing the staple cartridge, the detection switch is automatically tuned OFF to be in an inoperable state; and when the driver unit is fixed in the regular posture, the electric stapler is released from the inoperable state. For this reason, it is unnecessary to additionally manipulate a safety switch or the like, and the electric stapler is simply handled and has a high stability.

Other aspects and advantages of the invention will be apparent from the following description and the appended claims.

DESCRIPTION OF REFERENCE NUMERALS AND SIGNS

1: ELECTRIC STAPLER
2: BASE FRAME
3: DRIVER UNIT
7: FIXATION RELEASING HANDLE
8: CAM PLATE PORTION
8*a*, 8*b*: CONCAVE PORTION
9: DETECTION SWITCH
10: SWITCH LEVER
11: MAIN FRAME (3)
11*c*: GUIDE GROOVE
12: SLIDE FRAME (3)
13*a*, 13*b*: GUIDE PIN
14: LEVER
15: TENSION COIL SPRING
C: STAPLE CARTRIDGE

BEST MODE FOR CARRYING OUT THE INVENTION

Hereinafter, exemplary embodiments of the invention will be described with reference to the drawings.

Figure 1:
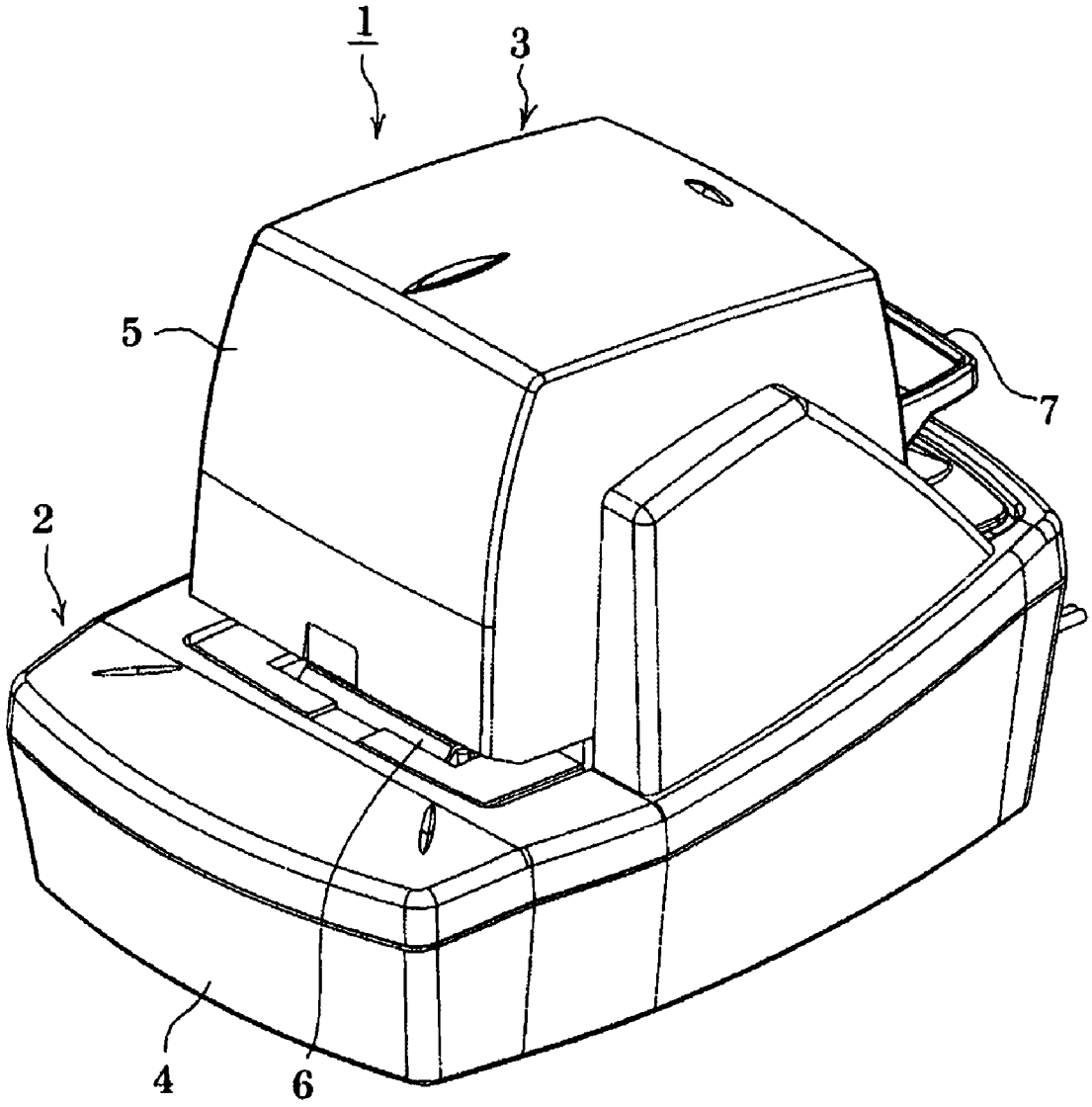
FIG. 1 is a front perspective view of an electric stapler according to an exemplary embodiment of the invention.
Figure 2:
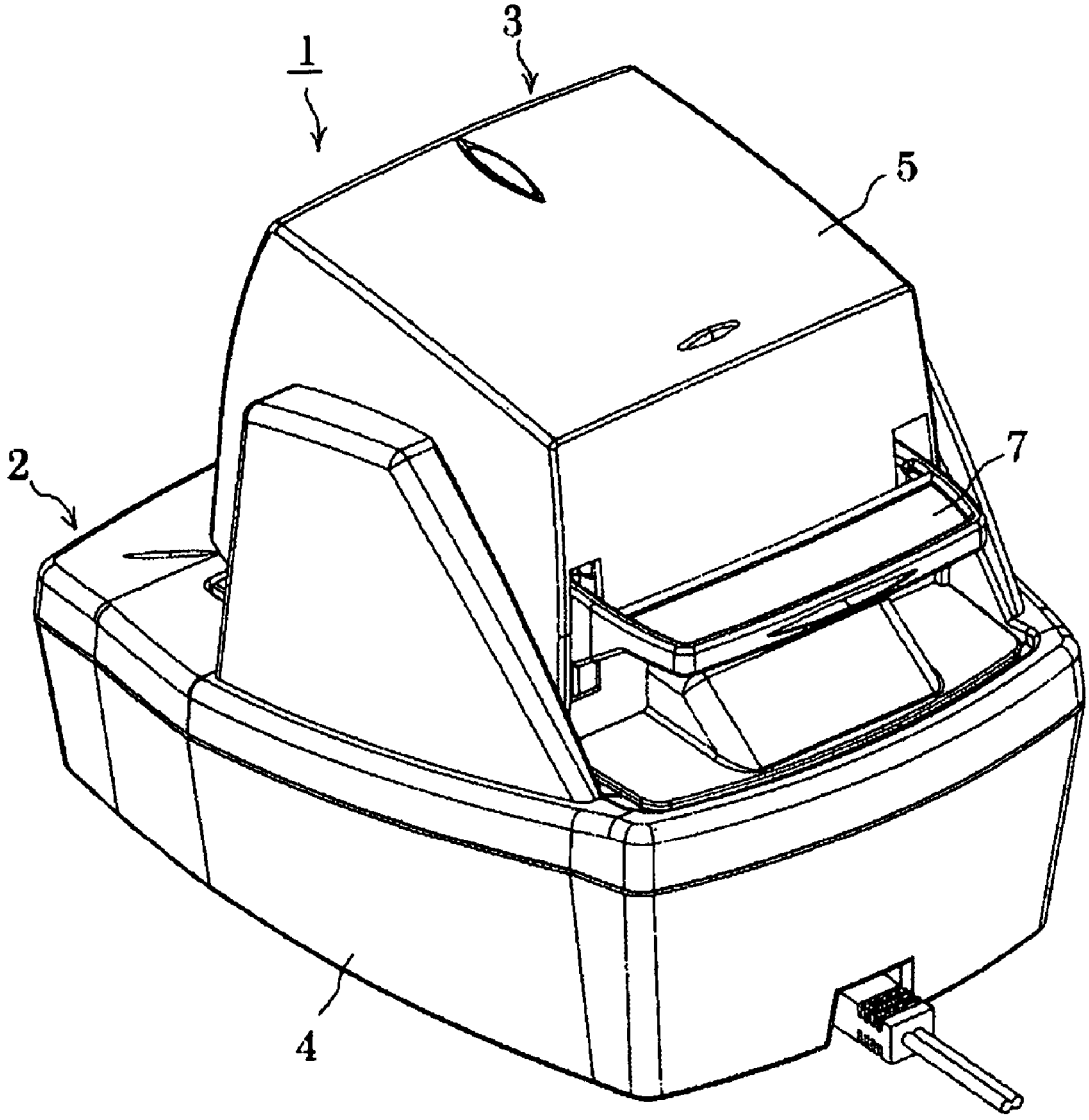
FIG. 2 is a rear perspective view of the electric stapler in FIG. 1.

FIG. 1 is a front perspective view of an electric stapler 1 and FIG. 2 is a rear perspective view thereof. The electric stapler 1 includes a base frame 2 and a driver unit 3 disposed above the base frame 2. The base frame 2 and the driver unit 3 are provided with plastic covers 4 and 5, respectively. The driver unit 3 is rotatably supported to vertical side plate portions 2*b* on both left and right sides of the base frame 2.

When paper is interposed into a front gap between the base frame 2 and the driver unit 3 shown in FIG. 1, a paper insertion detecting switch (not shown) disposed in the base frame 2 is pushed by the paper; a driver mechanism (not shown) in the driver unit 3 operates; the driver mechanism shoots a staple downward; the staple penetrating the paper is bent by a clincher 6 in the base frame 2; and thus the paper is filed.

The driver unit 3 is loaded with a staple magazine that accommodates staples. When all staples are consumed or clogging occurs due to the staple, the staple magazine can be replaced or the clogging staple can be removed by pulling up a fixation releasing handle 7 disposed on a rear surface of the driver unit 3 to be rotated forward and by vertically reversing the driver unit 3.

Figure 3:
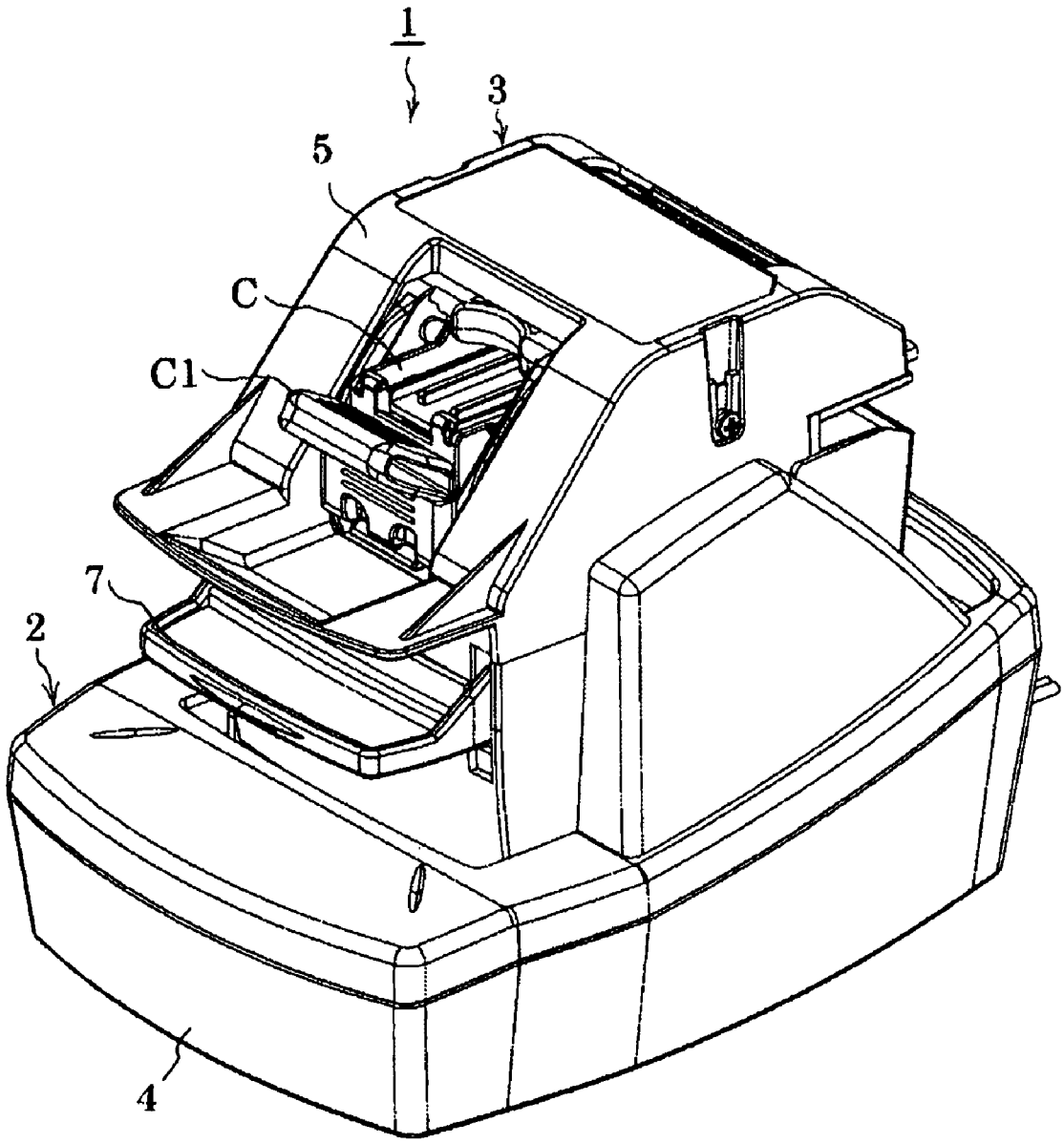
FIG. 3 is a front perspective view of a state where a driver unit of the electric stapler in FIG. 1 is reversed.
Figure 4:
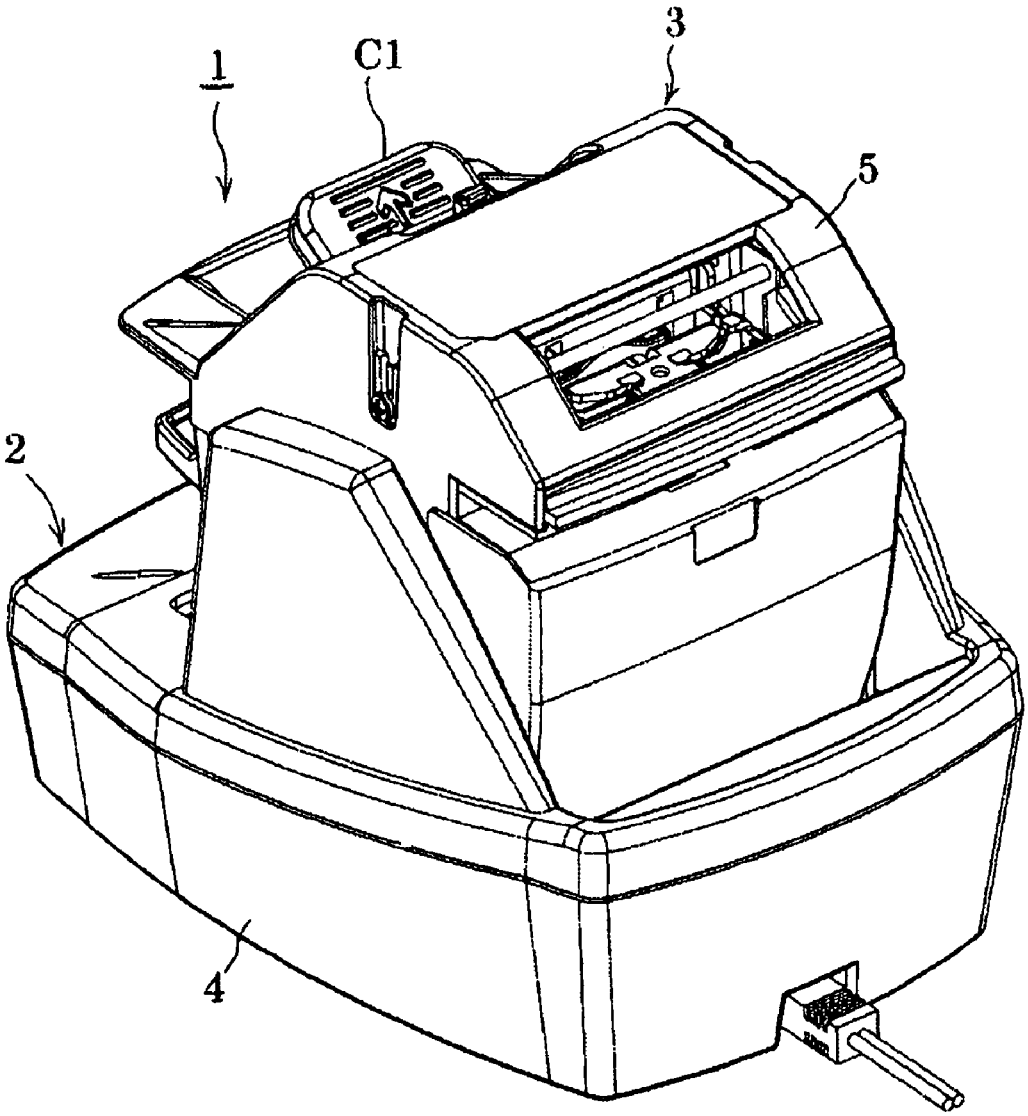
FIG. 4 is a rear perspective view of a state where a driver unit of the electric stapler in FIG. 1 is reversed.

FIGS. 3 and 4 show a state where the driver unit 3 is reversed by rotating the driver unit 3. FIG. 3 is a front perspective view and FIG. 4 is a rear perspective view. Reference sign C denotes a staple cartridge loaded in a cartridge chamber of the driver unit 3. Since a tap handle C1 is disposed in the vicinity (vicinity of the front upper portion in FIG. 3) of the rear lower portion of the driver unit 3, the staple cartridge can be taken out from the cartridge chamber by obliquely pulling the tap handle C1 in the upper-front direction in the reversed posture shown in FIG. 3.

Figure 5:
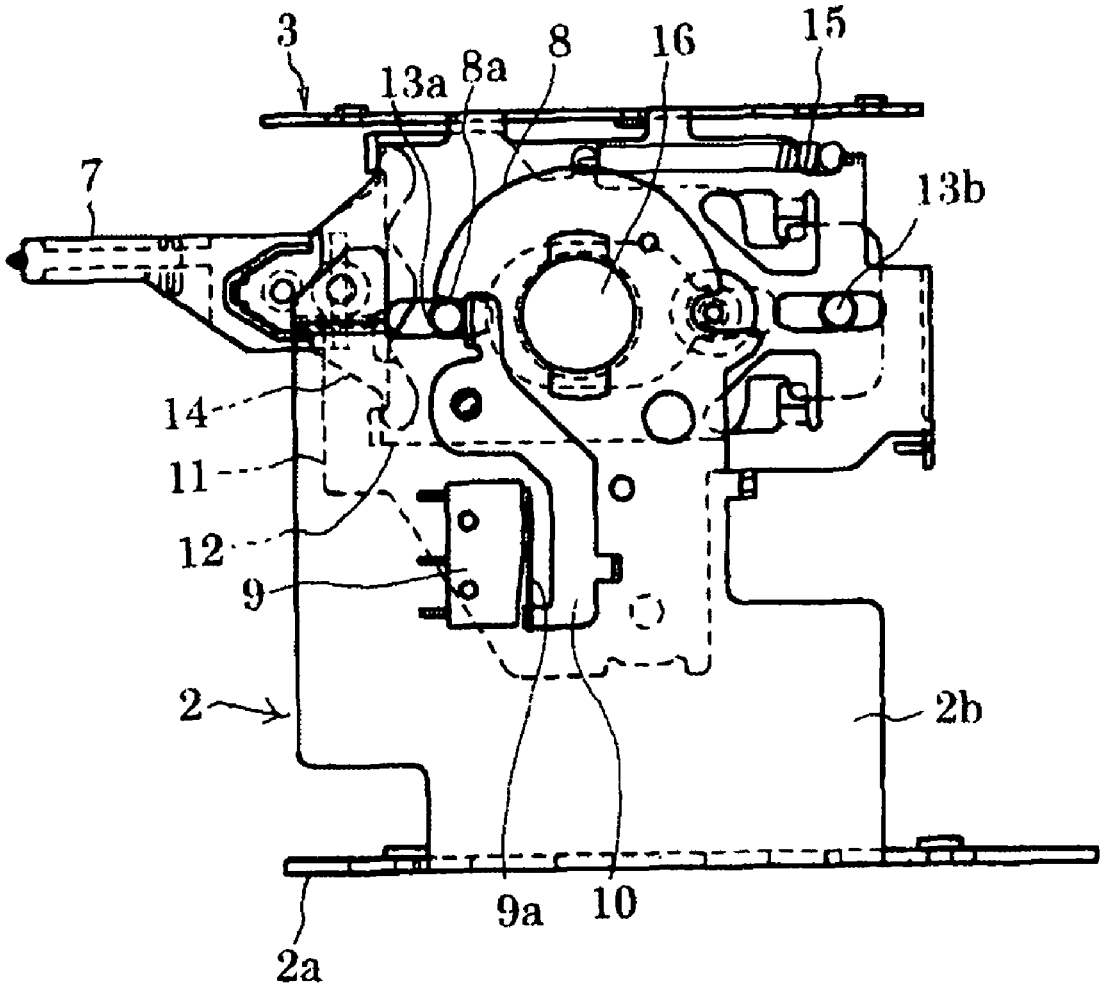
FIG. 5 is a side view of a chassis of the electric stapler in FIG. 1.
Figure 6:
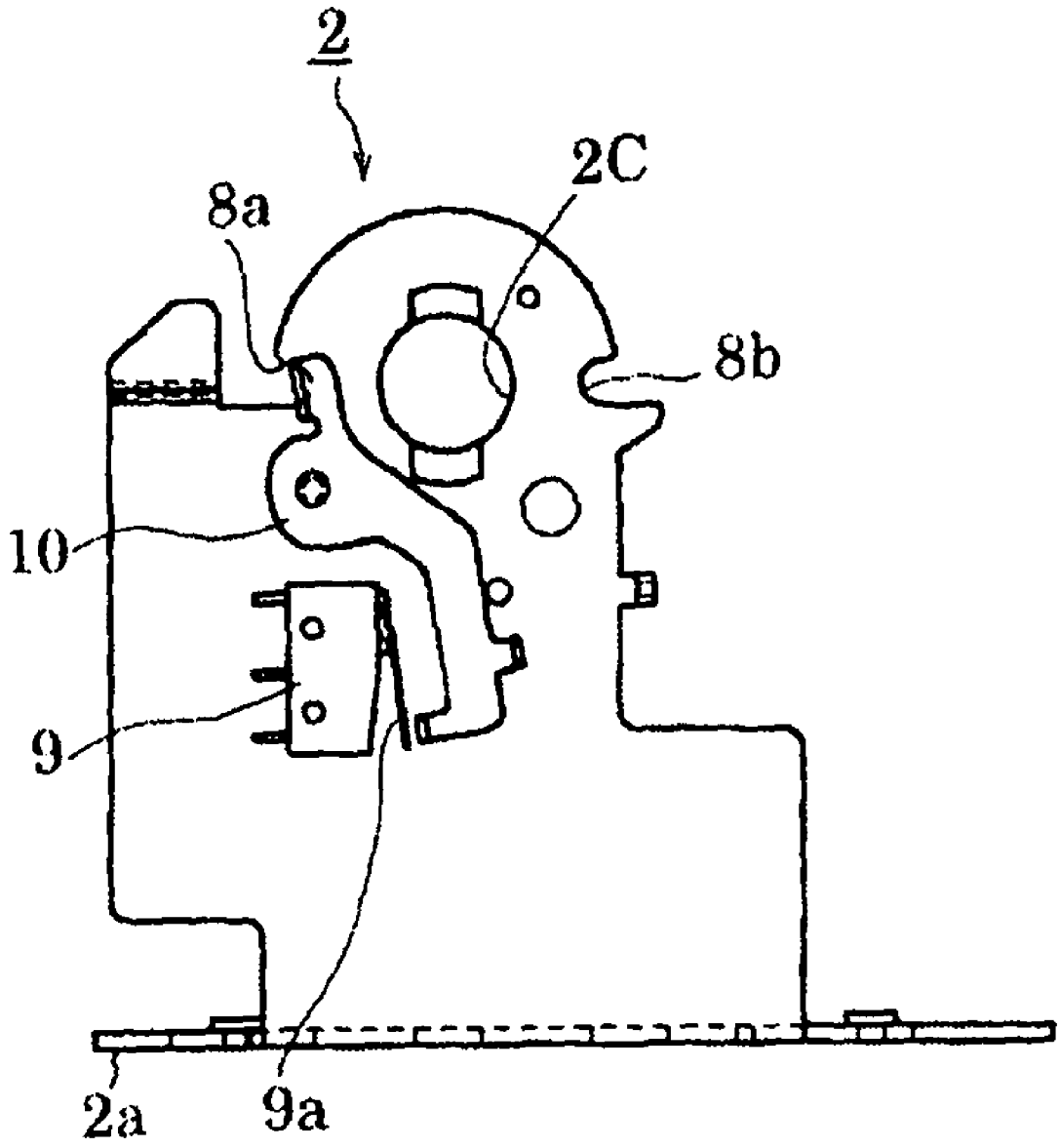
FIG. 6 is a side view of a base frame of the electric stapler in FIG. 1.
Figure 7:
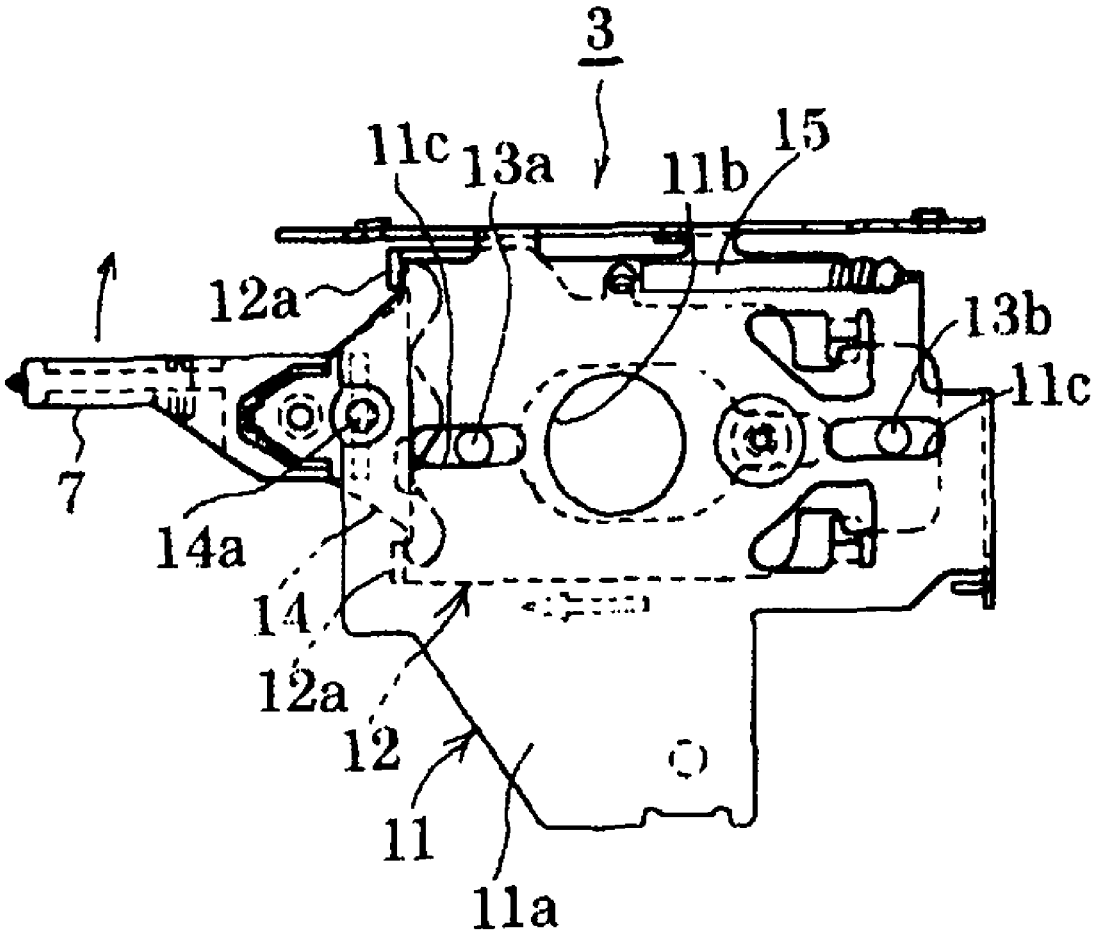
FIG. 7 is a side view of a driver unit of the electric stapler in FIG. 1.

FIG. 5 is a side view of a chassis in a state where the plastic covers 4 and 5 are detached from the base frame 2 and the driver unit 3 of the electric stapler 1, respectively, FIG. 6 is a side view of the base frame 2, and FIG. 7 is a side view of the driver unit 3. In FIGS. 5 to 7, the driver mechanism, the clincher, a motor, or the like is not shown, but only frame part is shown.

The side plate portions 2*b* are erected on the left and right (in the front-back direction of the sheet in FIGS. 5 and 6) of a bottom portion 2*a* of the base frame 2, and the driver unit 3 is supported by inserting a shaft (not shown) into shaft holes 2*c* formed on the left and right side plate portions 2*b*, respectively. An edge portion above the shaft hole 2*c* is formed in a semicircular shape having a center that is the shaft hole 2*c*, and concave portions 8*a* and 8*b* are formed in two front and rear portions of a cam plate portion 8 of the semicircular edge portion. The concave portions 8*a* and 8*b* of the cam plate portion 8 are configured to engage with guide pins of the driver unit 3 so as to fix the driver unit 3. The concave portions 8*a* and 8*b* are located on a horizontal line passing through the center of the shaft hole 2*c*.

In FIG. 6, a detection switch 9 and a switch lever 10 are attached to the front side plate portion 2*b*, the detection switch 9 connected to a signal input terminal of a control circuit or inserted to a power circuit is turn ON or OFF in the lower portion of the switch lever 10. The switch lever 10 is urged in a direction departing from a detection lever 9*a* of the detection switch 9 by a spring (not shown), and the upper portion of the switch lever 10 overlaps with the front concave portion 8*a* of the cam plate portion 8.

The driver unit 3 shown in FIG. 7 has a main frame 11 and a slide frame 12, shaft holes 11*b* are formed between the front and rear positions of the left and right side plate portions 11*a* of the main frame 11, respectively, and a pair of guide grooves 11*c* that are long in the front and rear directions are formed in front and rear of each shaft hole 11*b*. A pair of front and rear guide pins 13*a* and 13*b* formed in the slide frame 12 engage with the pair of guide grooves 11*c*, respectively, and the slide frame 12 can be horizontally slid back and forth.

A bell crank lever 14, both upper and lower portions of which are symmetrical each other about a rotation center shaft 14*a*, is attached to the front portion of the side plate portion 11*a* of the main frame 11. Both upper and lower portions of the lever 14 are located on rear surfaces of claws portions 12*a* disposed in both upper and lower portions on the front surface of the slide frame 12, respectively. A tension coil spring 15 is interposed between the rear upper portion of the main frame 11 and the upper portion of the slide frame 12 and the slide frame 12 is urged in the rear direction. Accordingly, the upper and lower claw portions 12*a* come in contact with the front surfaces of both upper and lower portions of the lever 14 so that the lever 14 is kept in a neutral position.

The fixation releasing handle 7 shown in FIGS. 1 to 4 is fixed to the center of the front portion of the lever 14. When the fixation releasing handle is rotated upward or downward, the lever 14 is rotated to push the claw 12*a* of the slide frame 12 from rear to front, thereby moving the slide frame 12 forward. When relinquishing the fixation releasing handle 7, the slide frame 12 is pulled by the tension coil spring 15 to retreat and then returns to the state shown in FIG. 7.

FIG. 5 shows a state where the driver unit 3 in FIG. 7 is mounted on the base frame 2 in FIG. 6, which is in the regular posture shown in FIGS. 1 and 2. The driver unit 3 and the base frame 2 are assembled by a shaft 16 that is inserted through the shaft holes. The front guide pin 13*a* of the driver unit 3 engages with the front concave portion 8*a* of the cam plate portion 8 to fix the driver unit 3 in the regular posture. The front guide pin 13*a* pushes down the upper portion of the switch lever 10 of the base frame 2 rearward, the lower portion of the switch lever 10 is rotated forward to push the detection lever 9*a* of the detection switch 9, and thus the detection switch is turned ON.

Figure 8:
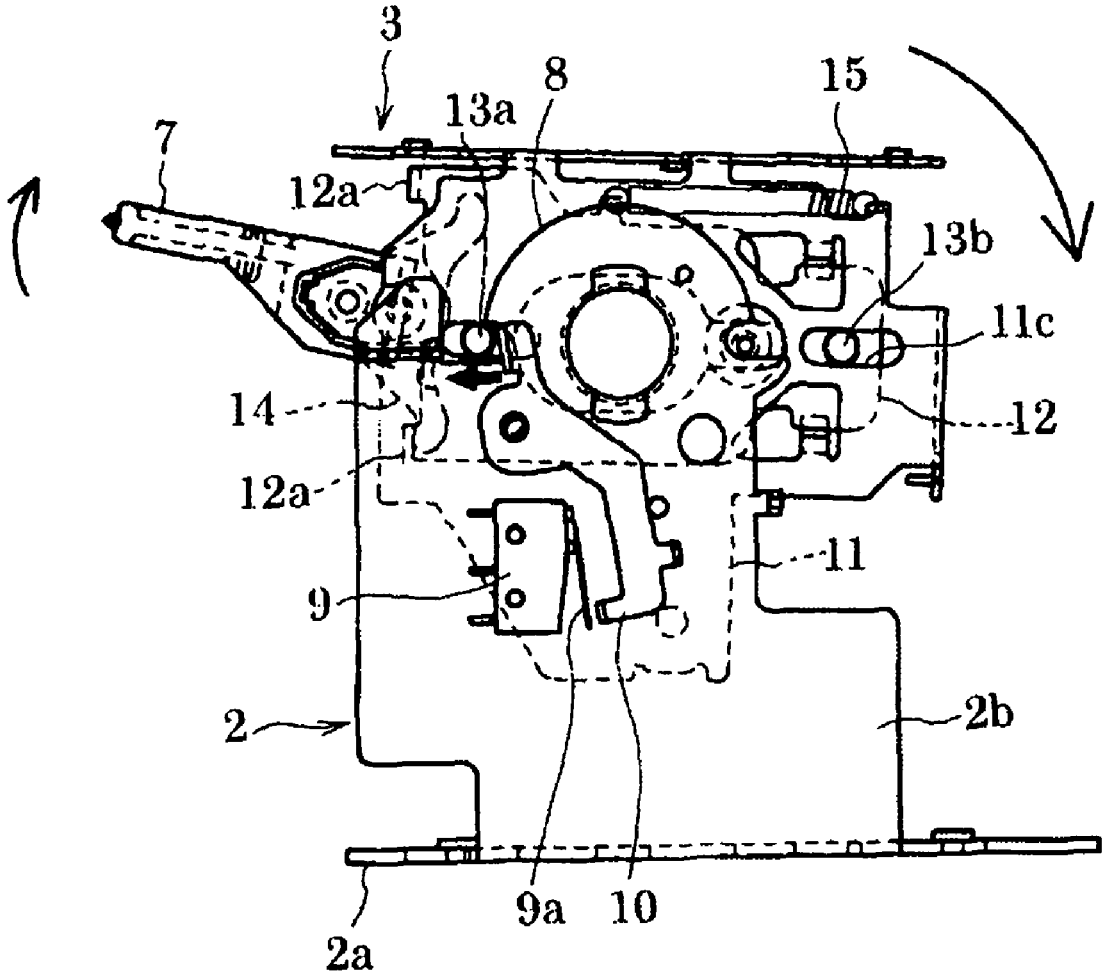
FIG. 8 is a side view of the chassis of the electric stapler illustrating a driver unit reversing motion.

As shown in FIG. 8, when the driver unit 3 is vertically reversed to replace or load the staple cartridge, the fixation releasing handle 7 is pulled up; the lever 14 is rotated to pull the slide frame 12 of the driver unit forward; the front guide pin 13*a* of the slide frame 12 departs from the concave portion 8*a* of the cam plate portion 8 of the base frame; the switch lever 10 released from the press of the front guide pin 13*a* departs from the detection lever 9*a* of the detection switch 9 by the force of the spring (now shown); and thus the detection switch 9 is turn OFF to be in the power cutoff state or the system shutdown state.

Figure 9:
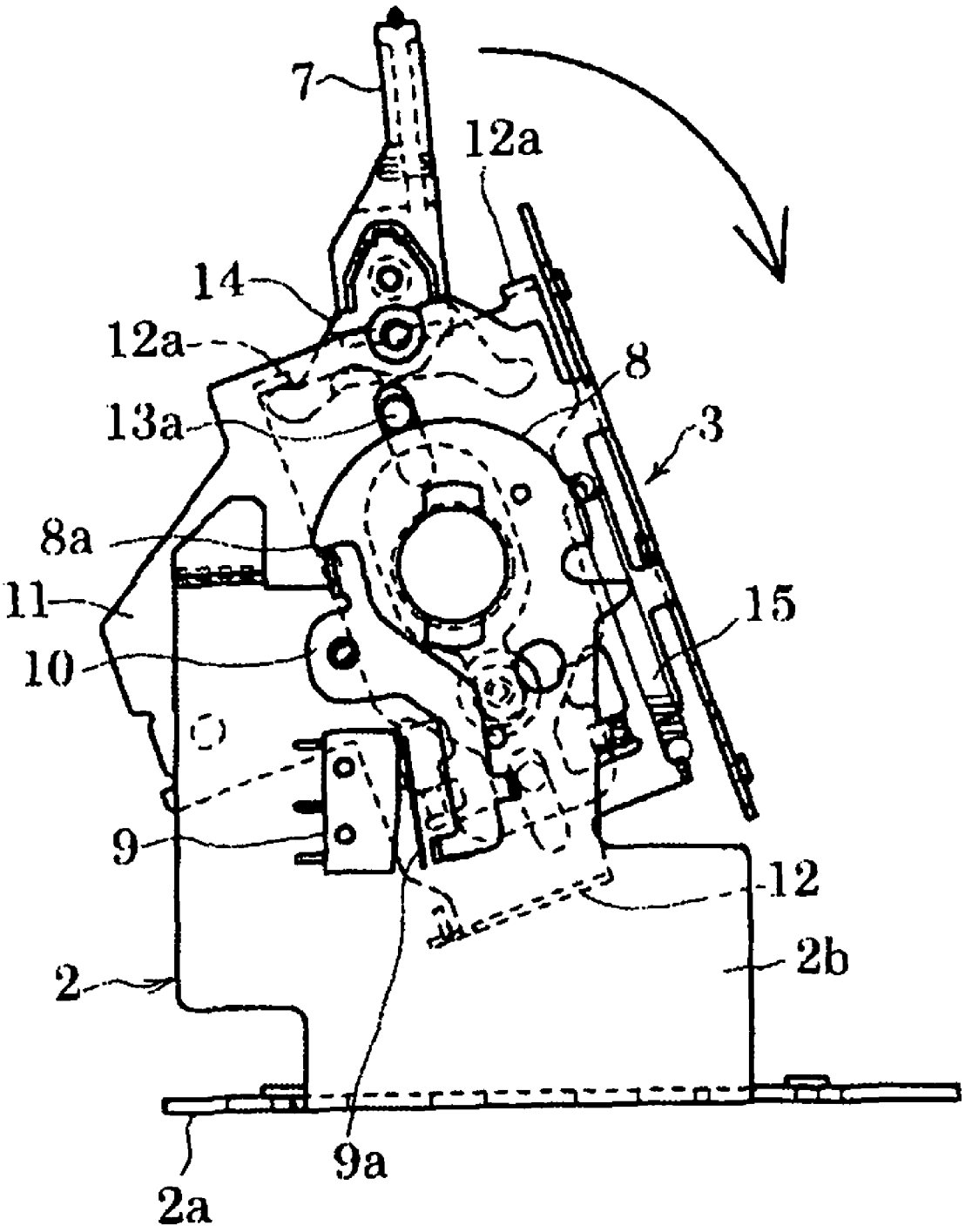
FIG. 9 is a side view of the chassis of the electric stapler illustrating a driver unit reversing motion.

The slide frame 12 is urged by the tension coil spring 15 disposed between the main frame 11 and the slide frame 12 of the driver unit 3 so that the front guide pin 13*a* comes in contact with the outer periphery of the cam plate portion 8. Accordingly, when the drive unit 3 is rotated while the fixation releasing handle 7 is further pulled up as shown in FIG. 9, the driver unit 3 is rotated in a state where the front guide pin 13*a* comes in contact with the outer periphery of the cam plate portion 8 of the base frame 2.

Figure 10:
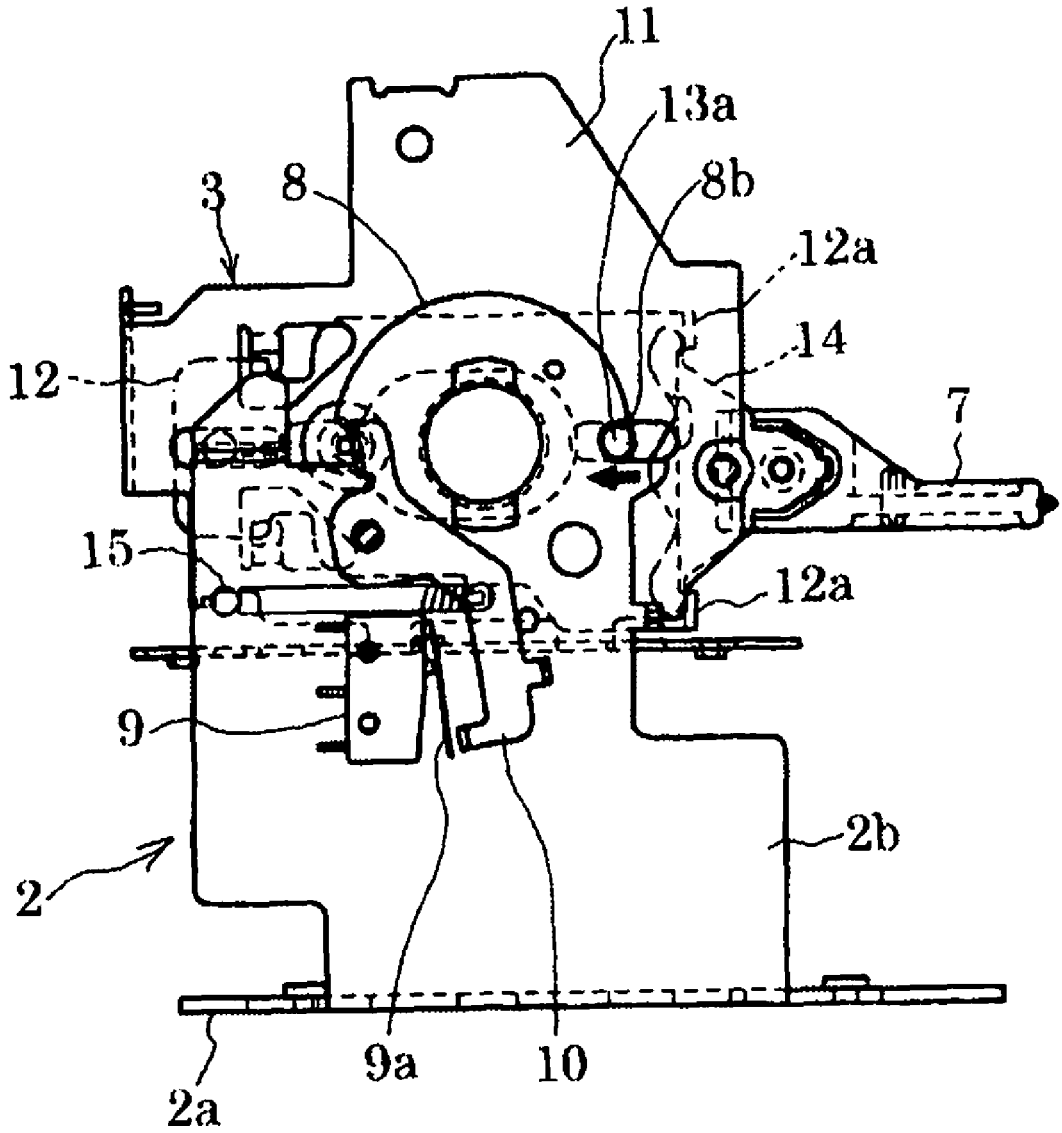
FIG. 10 is a side view of the chassis of the electric stapler illustrating a driver unit reversing motion.

As shown in FIG. 10, when the driver unit 3 is rotated by 180°, the front guide pin 13*a* (on the right side in FIG. 10) of the driver unit 3 engages with the rear concave portion 8*b* of the cam plate portion 8 of the base frame 2 and the driver unit 3 is fixed in the vertically reversed posture. In this state, it is possible to load or replace the staple cartridge in the upper portion.

When the fixation releasing handle 7 is pulled up in the state of loading the staple cartridge, the slide frame 12 moves so that the front guide pin 13*a* deviates from the rear concave portion 8*b* of the cam plate portion 8 of the base frame 2; the driver unit 3 is rotated to return to the initial state in FIG. 5; the front guide pin 13*a* of the slide frame 12 engages with the front concave portion 8*a* of the cam plate portion 8 of the base frame 2; and thus the driver unit 3 is fixed in the regular posture.

In this state, the front guide pin 13*a* pushes the upper portion of the switch lever 10 rearward, the lower portion of the switch lever 10 moves forward to push the detection lever 9*a* of the detection switch 9, the detection switch is turned ON, a control unit detects the detection switch 9 turned ON or the cutoff of the power circuit is released, and thus the stapler is in an operable state. At this time, in case of a stapler having control means for making a standby state capable of filing paper by transporting and forming staples in a cartridge at the time of replacing the cartridge, the standby operation is executed.

The invention is not limited to the above-described embodiments and may be variously modified within the technical scope of the invention, and it is apparent that the invention includes the modifications.

The application is based on Japanese Patent Application (Japanese Patent Application No. 2005-110773) filed on Apr. 7, 2005, and a content thereof is incorporated herein by reference.

INDUSTRIAL APPLICABILITY

The invention is applicable as a safety device of an electric stapler.

The invention claimed is:

1. An electric stapler comprising:

a base frame;

a driver unit attached to the base frame so as to be vertically reversed from a regular posture to a vertically reversed posture that is 180° from the regular posture;

a lock mechanism that locks the driver unit in the regular posture and the vertically reversed posture;

a detection switch that is turned ON when the driver unit is positioned in the regular posture and turned OFF when the driver unit is positioned in any position other than the regular posture; and a fixation releasing handle provided on the driver unit, wherein the lock mechanism is disengaged and the driver unit rotates by pulling up the fixation releasing handle in both the regular posture and the vertically reversed posture, wherein the electric stapler is operable when the driver unit is in the regular posture and is inoperable when the driver unit is in any posture other than the regular posture, based on a state of the detection switch, wherein the driver unit includes a main frame, a slide frame, and a lever, the slide frame is horizontally slidable back and forth with respect to the main frame and is urged in a rear direction by a spring, both upper and lower portions of the lever are located on a rear side of a front surface of the slide frame, said fixation releasing handle is fixed to a center of a front portion of the lever, when the fixation releasing handle is rotated upward or downward, the lever is rotated to push the slide frame from rear to front to move the slide frame forward, and an engagement between the slide frame and said base frame by said lock mechanism is disengaged, and wherein the main frame, the slide frame, and the lever integrally rotate with the driver unit with respect to the base frame.

2. The electric stapler according to claim 1, wherein a staple cartridge is filled or replaced when the driver unit is vertically reversed.

3. The electric stapler according to claim 1, wherein the lock mechanism includes:

a movable pin or a movable claw that is disposed in the driver unit; and an engagement portion including a concave portion formed in the base frame, wherein when the driver unit is locked in the regular posture, the movable pin or the movable claw of the lock mechanism engages with the engagement portion of the base frame and pushes the detection switch so as to turn ON the detection switch.

4. An electric stapler comprising:

a base frame;

a driver unit attached to the base frame through a shaft extending in a right-left direction, the driver unit being rotatable around the shaft with respect to the base frame between a first posture and a second posture;

a lock mechanism that locks the driver unit in the first posture and the second posture;

a detection switch that is turned ON when the driver unit is positioned in the first posture and turned OFF when the driver unit is positioned in any posture other than the first posture, wherein the electric stapler is operable when the driver unit is in the first posture and is inoperable when the driver unit is in any posture other than the first posture, based on a state of the detection switch; and a fixation releasing handle provided on the driver unit, wherein the lock mechanism is disengaged and the driver unit is rotated by pulling up the fixation releasing handle in both the first posture and the second posture, wherein the driver unit includes a main frame, a slide frame, and a lever, the slide frame is horizontally slidable back and forth with respect to the main frame and is urged by a spring, the lever is in direct contact with the slide frame, said fixation releasing handle is fixed to the lever, when the fixation releasing handle is rotated, the lever moves the slide frame against an urging force of the spring, and an engagement between the slide frame and said base frame by said lock mechanism is disengaged.

5. The electric stapler according to claim 4, wherein the main frame, the slide frame, and the lever integrally rotate with the driver unit with respect to the base frame.

6. The electric stapler according to claim 5, wherein the lock mechanism includes:

a pin provided on the slide frame;

a first concave portion formed on the base frame; and a second concave portion formed on the base frame, wherein when the driver unit is in the first posture, the pin engages with the first concave portion to lock the driver unit in the first posture, and wherein when the driver unit is in the second posture, the pin engages with the second concave portion to lock the driver unit in the second posture.

7. The electric stapler according to claim 6, wherein the lever moves the slide frame against the urging force of the spring to disengage an engagement between the pin and the first concave portion by rotating the fixation releasing handle upward in the first posture, wherein the lever moves the slide frame against the urging force of the spring to disengage the engagement between the pin and the first concave portion by rotating the fixation releasing handle downward in the first posture, wherein the lever moves the slide frame against the urging force of the spring to disengage an engagement between the pin and the second concave portion by rotating the fixation releasing handle upward in the second posture, and wherein the lever moves the slide frame against the urging force of the spring to disengage the engagement between the pin and the second concave portion by rotating the fixation releasing handle downward in the second posture.

8. The electric stapler according to claim 1, wherein the lock mechanism includes:

a pin provided on the slide frame;

a front concave portion formed on the base frame; and a rear concave portion formed on the base frame, wherein when the driver unit is in the regular posture, the pin engages with the front concave portion to lock the driver unit in the regular posture, and wherein when the driver unit is in the vertically reversed posture, the pin engages with the rear concave portion to lock the driver unit in the vertically reversed posture.

9. The electric stapler according to claim 8, wherein the lever moves the slide frame against an urging force of the spring to disengage an engagement between the pin and the front concave portion by rotating the fixation releasing handle upward in the regular posture, wherein the lever moves the slide frame against the urging force of the spring to disengage the engagement between the pin and the front concave portion by rotating the fixation releasing handle downward in the regular posture, wherein the lever moves the slide frame against the urging force of the spring to disengage an engagement between the pin and the rear concave portion by rotating the fixation releasing handle upward in the vertically reversed posture, and wherein the lever moves the slide frame against the urging force of the spring to disengage the engagement between the pin and the rear concave portion by rotating the fixation releasing handle downward in the vertically reversed posture.

10. The electric stapler according to claim 9, wherein the lever is in direct contact with the slide frame.

* * * * *